United States Patent [19]

Booker

[11] Patent Number: 4,676,572

[45] Date of Patent: Jun. 30, 1987

[54] ELECTRICAL CONTACT RETAINER

[75] Inventor: William L. Booker, Kirkland, Wash.

[73] Assignee: The Boeing Company, Seattle, Wash.

[21] Appl. No.: 779,418

[22] Filed: Sep. 24, 1985

[51] Int. Cl.[4] ..... H01R 13/639

[52] U.S. Cl. ..... 439/301; 439/382; 439/723

[58] Field of Search ..... 339/91 R, 204, 205, 339/80, 93 R, 93 C

[56] References Cited

U.S. PATENT DOCUMENTS

| | | | |
|---|---|---|---|
| 1,975,885 | 10/1934 | Wellman | 173/363 |
| 2,299,787 | 10/1942 | Beal | 173/328 |
| 2,431,583 | 11/1947 | Penfold | 173/328 |
| 3,107,964 | 10/1963 | Wolf | 339/205 |
| 3,161,451 | 12/1964 | Neidecker | 339/91 |
| 3,278,890 | 10/1966 | Cooney | 339/93 C |
| 3,358,266 | 12/1967 | Chandler et al. | 339/205 |
| 3,383,642 | 5/1968 | Nava et al. | 339/205 |
| 4,163,594 | 8/1979 | Aujla | 339/82 |
| 4,522,458 | 6/1985 | Werth et al. | 339/80 |
| 4,597,621 | 7/1986 | Burns | 339/89 M |

*Primary Examiner*—John McQuade

*Attorney, Agent, or Firm*—Finnegan, Henderson, Farabow, Garrett & Dunner

[57] ABSTRACT

A retainer has tabs which hold a pin and socket in good electrical contact until a separation force applied to the pin and socket exceeds a predetermined amount and breaks or bends the tabs, thereby ensuring a predictable separation of the pin and socket in response to large separation forces.

5 Claims, 5 Drawing Figures

ELECTRICAL CONTACT RETAINER

The Government has rights in this invention pursuant to Contract No. N0019-83-C-0176 awarded by the U.S. Navy.

BACKGROUND OF THE INVENTION

The present invention relates to the field of cable retainers and, in particular, to the use of such retainers in aircraft engine cabling.

Airplane engines which are wing-mounted are rigidly attached to a strut which is itself mounted to a wing. FIG. 1 shows an airplane engine 1 mounted to wing 2 via strut 3. Airplane engines are also mechanically coupled to alternators or generators which convert the engines' mechanical energy into electrical power, typically 3-phase, 400 Hz, which is supplied to the airplane avionics and other electrical subsystems. FIG. 1 shows in phantom line an alternator 4 coupled to provide such electrical power. Cabling, such as cable set 5, runs from the alternator 4 to the body of the airplane to carry the electrical power. Such cabling generally includes, for each phase, two conductors, typically #1/0 wire, or a total of six conductors for a conventional engine. The conductors in such cables usually pass through a connector, such as connector 6 in FIG. 1, one portion of which is rigidly mounted in the rear bulkhead of the strut. Additional cabling running from the other side of the bulkhead to the body of the airplane is connected to the mounted portion of the connector.

The standard connector, which is called an MS connector, can accommodate 4–6 conductors. Each portion of such a connector contains either pins or sockets molded to the connector. Such connectors are typically three (3) inches in diameter and can withstand 6000 pounds of tension.

Although the strength of such connectors must be great to withstand the airplane environment, occasionally the connector's strength causes problems. The loss of an airplane engine during flight due to failure of a strut holding that engine will not usually cause the airplane to crash. The remaining engines can normally provide sufficient power for flight. In the past, a more significant problem caused by a broken strut is the destruction of the wing by an engine which has not separated from the broken strut. What happens is that the engine remains tethered to the wing by the six or more power conductors and connector. Since the cable and the associated conductors are very strong, as is the connection at the MS connector, the engine does not drop freely, but instead swings around and damages the wing.

An additional problem with MS connectors is their size. The aircraft industry is moving toward the use of larger engines. In order to preserve conventional ground clearance while using such larger engines, airplane manufacturers have chosen to reduce the size of the struts. The MS connectors may be found to be too large to be mounted on the rear strut bulkheads of these smaller struts.

OBJECTS AND SUMMARY OF THE INVENTION

An object of the present invention is to provide a cable retainer which will allow an engine to separate in a predictable manner from the airplane when the engine strut breaks, thereby maintaining the integrity of the airplane.

Another object of the present invention is to provide a device that will allow a cable to disconnect predictably when the tension on the cable exceeds a predetermined amount.

A further object of this invention is to provide a cable retainer that keeps a cable pin and socket connected together in good electrical contact so long as the separation force on the pin and socket is less than a predetermined amount, and when the separation force exceeds that predetermined amount, predictably allows the pin and socket to separate as predicted.

Yet another object of this invention is to provide a retainer which allows a cable to separate at a pin and socket junction in a predictable manner when the separation force exceeds a predetermined amount, but which does not occupy significantly more space than the cabling itself.

The present invention overcomes the problems of the prior art and achieves the objects of the invention by providing a retainer with a structure for holding a pin and socket together. The structure is designed to fracture or relax its holding force when a separating force on the pin and socket exceeds a predetermined amount.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

To achieve the objects and in accordance with the purposes of this invention, the retainer of this invention comprises a tubular structure for enclosing a pin and socket connection when the pin and socket are mated in electrical contact with each other, the tubular structure having an outer surface, recessed portions formed in the outer surface, a plurality of resilient tabs extending inwardly from the recessed portions and engaging the pin and socket, the tabs normally preventing the disengagement of the pin and socket and being breakable under predetermined load, a layer of insulation surrounding the outer surface of the tubular structure, the insulation being out of contact with the recessed portions where the tabs are formed.

The accompanying drawings, which are incorporated in and constitute a part of this specification, illustrate an embodiment of the invention, and, together with the description, explain the principles of the invention.

DESCRIPTION OF THE PREFERRED EMBODIMENT

Reference will now be made in detail to a presently preferred embodiment of the invention which is illustrated in the accompanying drawings.

Figure 1:
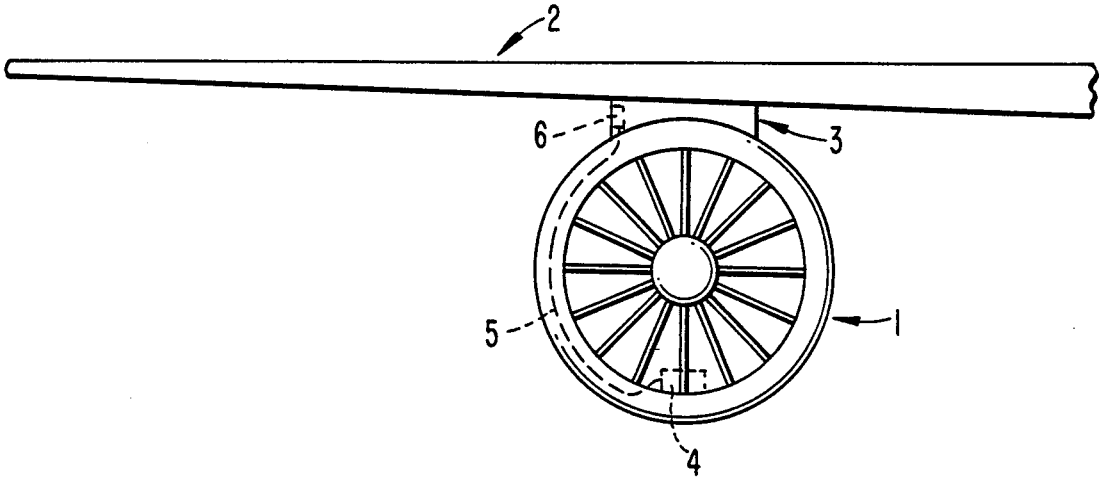
FIG. 1 is a schematic representation of an airplane engine mounted on a portion of an airplane wing.
Figure 2:
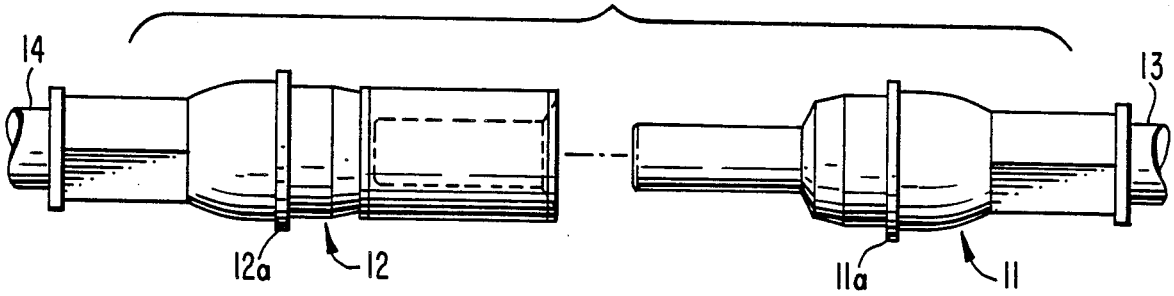
FIG. 2 is a longitudinal view of a pin and socket in a disengaged position.

FIG. 2 shows a typical pin 11 and a socket 12 for a cable in the disengaged position. Pin 11 and socket 12 are connected to cables 13 and 14, respectively, as part of standard cable connection. The pin and socket mate in a male-female relationship. The fit between the pin and socket is relatively tight in order to prevent them from disengaging during normal handling. The pin and socket fit cannot be too tight, however, because the cables must be capable of being disconnected for testing and replacement.

Pin and socket connections are subject to a "separation force". For purposes of this patent, the term "separation force" refers to forces on the pin and socket, applied either directly to the pin and sockets themselves or indirectly via the cables connected to the pin and socket, which tend to move the pin and socket away from each other. Such separation forces on aircraft cabling can either be relatively small, for example, from a worker disengaging the pin and socket during testing or the normal forces occurring during flight, or the separation forces can be very large, for example when an aircraft engine for whatever reason separates and falls from the wing. To prevent unintentional separation of the pin and socket connection, retainers are provided. Preferably a retainer should resist the small separation forces but succumb to the larger forces.

Figure 3A:
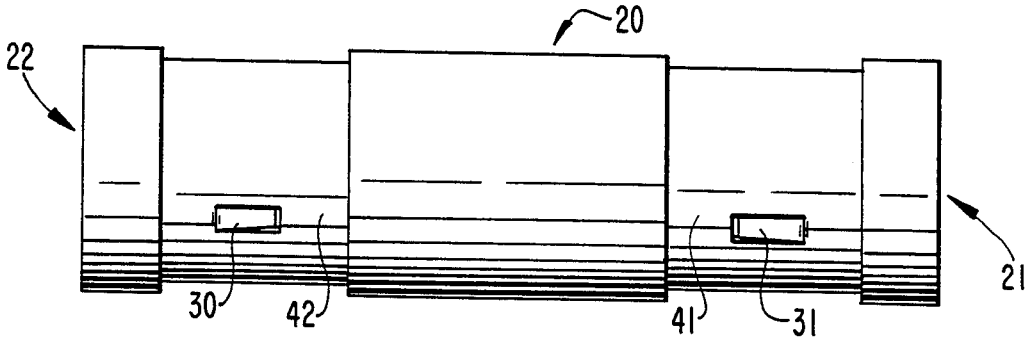
FIG. 3*a* shows an exterior view of a retainer constructed according to this invention but with the exterior insulation removed; an end view of the retainer of FIG. 3*a;*
Figure 3B:
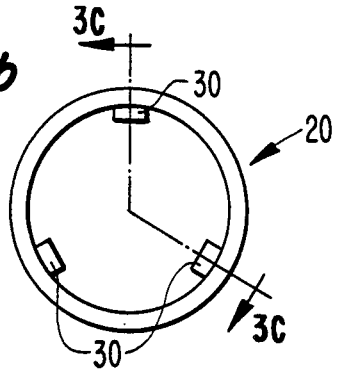
FIG. 3*b* shows an end view of the retainer of FIG. 3*a;*.
Figure 3C:
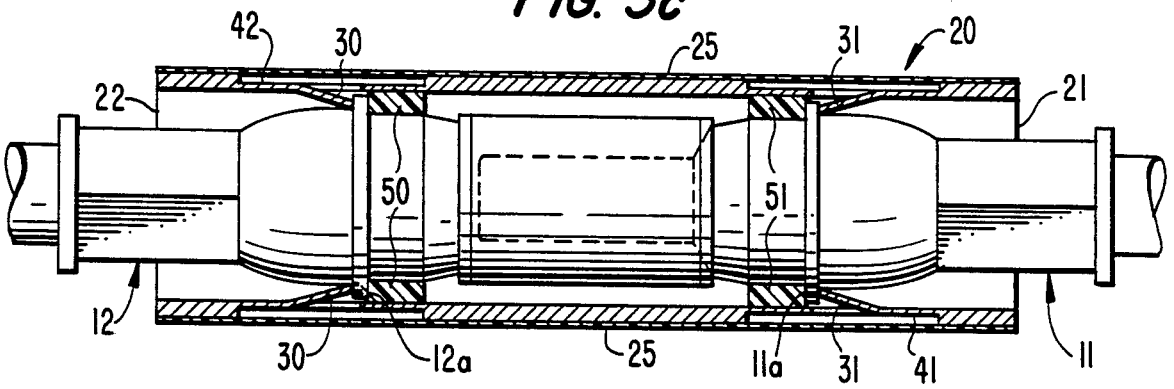
FIG. 3*c* is a longitudinal view of the retainer, in section, taken along the line 3*c*—3*c* of FIG. 3*b* and showing the retainer surrounding an engaged pin and socket.

FIGS. 3*a*–3*c* show a retainer 20 constructed in accordance with the teachings of the present invention for holding a pin and socket in good electrical contact. The retainer is preferably connected in-line, and not on a bulkhead as in the prior art. This in-line connection makes the retainer of this invention much smaller than the standard MS connector, and thus more compatible with the smaller struts currently contemplated by aircraft designers.

In accordance with the present invention, the retainer includes a structure enclosing the pin and socket when they are mated in good electrical contact. Retainer 20 is substantially cylindrical and, as shown, has an outer diameter of approximately 0.744 inches and an inner diameter of approximately 0.664 inches. The inner and outer diameters of the retainer can, of course, be different as can the shape of the retainer. For example, if a larger inner diameter is needed to accommodate larger pins and sockets, the outer diameter would also increase so that the retainer would be thick enough to ensure that the structure was sufficiently strong.

Retainer 20 contains an opening 21 into which the pin enters and an opening 22 into which the socket enters. As the preferred embodiment in FIGS. 3*a*–3*c* shows, the retainer is symmetrical about its longitudinal axis so openings 21 and 22 would be identical. Of course, depending upon the application, the openings may be different to meet different requirements.

Preferably, retainer 20 is made from beryllium copper. This material, when heat treated, exhibits the necessary strength and fracture properties needed for this invention. In operation, retainer 20 is surrounded by insulation 25. Preferably such insulation is a teflon tube, but any standard insulation is acceptable sso long as it is compatible with the objects and operation of this invention.

In accordance with the present invention, the retainer includes means coupled to the pin and socket for resisting a separation force on the pin and socket of less than a predetermined amount, thereby preventing movement of the pin and socket away from each other, and for allowing the resistance to separation force to be overcome, thereby allowing movement of the pin and socket away from each other, when the separation force exceeds the predetermined level.

In the preferred embodiment shown in FIGS. 3*a*–3*c*, such means includes tab sets 30 and 31 which are formed in the body of retainer 20. Preferably tab sets 30 and 31 each includes three equally-spaced tabs. Such an arrangement not only provides a symmetrical force on the pin and socket but also prevents the retainer from slipping on the pin and socket. The tabs in tab sets 30 and 31 are preferably rectangular cutouts with three orthogonal sides cut away from the body of the cylindrical retainer. Two of the sides are of equal length, preferably about 0.20 inches, and the remaining connecting side is shorter, preferably about 0.08 wide. Of course, other tab sizes and shapes can be used, and different numbers and arrangements of tabs can also be provided. The tabs in tab sets 30 and 31 are also each bent inwardly from the surface of retainer 20, i.e., toward the center, at an angle of about 15°.

As FIGS. 3*a*–3*c* show, the retainer 20 has two recessed portions 42 and 41, in which are formed tab sets 30 and 31, respectively. The purpose of the recessed portions has to do with insulation 25 and is explained in greater detail below. It is important in manufacturing the retainer of this invention that these portions not be recessed too deeply because if the remaining material of the recessed portions is too thin, it will affect the structural integrity of the retainer and not allow sufficient strength for the tabs cut into this portion of the retainer. In the preferred embodiment, the thickness of portions 41 and 42 is about 0.028 inches.

To mount the retainer on the cable, pin 11 and socket 12 are inserted into opposite ends of the retainer until the tabs 31,30 catch shoulder portions 11*a* and 12*a*, respectively. At this point, the pin and socket are in good electrical contact. Upon entry of the pin and socket, the respective shoulder portions bend the tabs away from the retainer slightly. Because the tabs are heat treated beryllium copper, however, they are resilient and spring back to catch the respective shoulder portions.

When engaging the shoulder portions of a mated pin and socket, tab sets 30 and 31 oppose any force tending to separate pin 11 and socket 12. The amount of the separation force which is to be resisted determines the size and shape of the tabs is tab sets 30 and 31. When pin 11 and socket 12 are subjected to more than that predetermined amount of separation force, the resultant force that the pin 11 and socket 12 then apply to the tabs of tab sets 31 and 30, respectively, cause the tabs to bend or shatter so the pin and socket can separate. The predetermined force for the retainer 20 in FIGS. 3*a*–3*c* is approximately two thousand pounds. To provide a retainer with increased strength, i.e., with tabs which break or bend in response to a larger predetermined force, the tabs can be made larger or additional tabs can be used.

Although the cables themselves will eventually fracture if the separation force is large enough, the point at which such fractures will occur is not always predictable and not adjustable since other considerations go into the selection of cable and connector materials. The present invention offers the advantages of predictability of cable separation as well as selectability of the point of separation in response to a separation force smaller than the cable fracture point.

The purpose of the recessed portions described above is to further predictability. As indicated, the retainer is typically covered with an insulation tube. Through experimentation, it was found that without the recessed portion, the insulation pushed inwardly on the tabs under stress and tended to change the breaking or bending point of the tabs. By recessing the portion of the retainer which contains the tabs, such stress was removed so that the tabs could break and bend as predicted.

Retainers 20 are preferably mounted forward of the aft strut bulkhead of the wing. This mounting position allows the engine to separate from the wing if the strut breaks. Since a falling engine will apply more than the predetermined amount of separation force on the pins and sockets of the cables, the engine can fall away from the airplane since separation of the cable will occur forward of the aft strut bulkhead.

Also provided in accordance with the retainer of this invention is vibration dampening means mounted in contact with the pin and socket for reducing the movement between the retainer and the coupled pin and socket. In the preferred embodiment, teflon rings 50 and 51 fit over the socket and pin as shown in FIG. 3*c*. These teflon rings fit tightly on the pin and socket. Because these rings tighten the fit of retainer 20 on the pin and socket, they reduce the amount that the pin and socket can move relative to retainer 20 and thereby dampen internal vibrations.

To make the retainer in accordance with the present invention, an appropriately sized stock of beryllium copper is drilled to produce the desired inner diameter. The resulting hollow cylinder is then machined to form two recessed portions on the outer surface of the drilled stock. As an alternative to drilling, an appropriately sized tube stock may also be used.

Then, using an electron discharge machine, sets of tabs are formed in the drilled stock in the recessed portions. Specifically, the electron discharge machine will form for each tab two equal-length slits parallel to the retainer axis and a third slit perpendicular to that axis and connecting the two parallel equal-length slits. The result is a three sided rectangular cut-out. The tabs are then bent towards the center of the drilled stock, preferably at an angle of 15° with respect to the surface of the drilled stock.

The resulting stock is then machined and heat treated until the beryllium copper is of the proper rigidity so the tabs will bend when the pin and socket are inserted and break at a predetermined separation force.

It will be apparent to those skilled in the art that modifications and variations can be made in the retainer methods and apparatus of this invention. For example, the retainer can have only one set of tabs which contact either the pin or socket, and the retainer can be securred to the connector member not in contact with the tabs. The invention in its broader aspects is not limited to the specific details, representative methods and apparatus, and illustrative examples shown and described. Departure may be made from such details without departing from the spirit or scope of the general inventive concept.

What is claimed is:

1. A retainer for preventing the disengagement of an electrical pin and socket connection comprising:

a tubular structure for enclosing said pin and socket connection when said pin and socket are mated in electrical contact with each other, said tubular structure having:

an outer surface, recessed portions formed in said outer surface, a plurality of resilient tabs extending inwardly from said recessed portions for engaging said pin and said socket, said tabs normally preventing the disengagement of said pin and socket and being breakable under predetermined load, a layer of insulation surrounding the outer surface of said tubular structure, said insulation being out of contact with the recessed portions where said tabs are formed.

2. A retainer as claimed in claim 1 wherein:

said recessed portions include first and second circumferential recesses formed in said outer surface of said tubular structure, and said plurality of resilient tabs include first and second sets of tabs, said tabs in first set being spaced around the outer surface of said tubular structure and extending inwardly from said first circumferential recess for engaging said pin, and said tabs in said second set being spaced around the outer surface of said tubular structure and extending inwardly from said second circumferential recess for engaging said socket.

3. A retainer as claimed in claim 2 wherein each set of tabs includes three tabs and each of said tabs has a three-sided, substantially rectangular shape which is cut from the recess from which it extends.

4. A retainer as claimed in claim 1 wherein said tubular structure additionally has:

an inner surface, a first ring mounted on said inner surface for contacting said pin, a second ring mounted on said inner surface for contacting said socket, said first and second rings reducing movement of the mated pin and socket within said retainer.

5. A retainer as claimed in claim 4 wherein said tubular structure is made of beryllium copper, said layer of insulation is a tube made of teflon, and said rings are made of teflon.

* * * * *